US009783930B2

(12) United States Patent
Luna Marroquín et al.

(10) Patent No.: US 9,783,930 B2
(45) Date of Patent: Oct. 10, 2017

(54) HYDROPHOBIC PAPER OR CARDBOARD WITH SELF-ASSEMBLED NANOPARTICLES AND METHOD FOR THE PRODUCTION THEREOF

(71) Applicant: SIGMA ALIMENTOS, S. A. DE C. V., San Pedro Garza Garcia (MX)

(72) Inventors: Néstor Luna Marroquín, Nuevo Leon (MX); Orlando Severiano Pérez, Tlalnepantla (MX); Joel Gutiérrez Antonio, Naulcalpan de Juarez (MX); Rodrigo Pámanes Bringas, Santa Catarina (MX); Gregorio José De Haene Rosique, San Pedro Garza Garcia (MX); Julio Gómez Cordón, Logroño (ES)

(73) Assignee: SIGMAQ ALIMENTOS, S.A. DE C.V., San Pedro Garza Garcia (MX)

( * ) Notice: Subject to any disclaimer, the term of this patent is extended or adjusted under 35 U.S.C. 154(b) by 0 days.

(21) Appl. No.: 14/394,090

(22) PCT Filed: Apr. 12, 2013

(86) PCT No.: PCT/MX2013/000047
§ 371 (c)(1),
(2) Date: Oct. 12, 2014

(87) PCT Pub. No.: WO2013/154414
PCT Pub. Date: Oct. 17, 2013

(65) Prior Publication Data

US 2015/0330025 A1 Nov. 19, 2015

(30) Foreign Application Priority Data

Apr. 13, 2012 (MX) ..... MX/a/2012/004387

(51) Int. Cl.
*D21H 17/11* (2006.01)
*D21H 17/13* (2006.01)
(Continued)

(52) U.S. Cl.
CPC ..... *D21H 17/11* (2013.01); *D21H 11/00* (2013.01); *D21H 17/13* (2013.01); *D21H 17/67* (2013.01);
(Continued)

(58) Field of Classification Search
CPC ..... D21H 21/16; D21H 21/52; D21H 17/13; D21H 17/35; D21H 17/59; D21H 17/675;
(Continued)

(56) References Cited

U.S. PATENT DOCUMENTS 4,268,069 A * 5/1981 Stolfo ..... B41M 5/1243 427/150
5,624,471 A * 4/1997 Gaeta ..... B24D 3/28 51/295
(Continued)

FOREIGN PATENT DOCUMENTS

AT EP 1925732 A1 * 5/2008 ..... D21H 17/675
CA GB 2427868 A * 1/2007 ..... D21H 21/16
(Continued)

OTHER PUBLICATIONS

Pilotek et al., "Wettability of Microstructured Hydrophobic Sol-Gel Coatings," 2003, Journal of Sol-Gel Science and Technology, 26, pp. 789-792.*
(Continued)

*Primary Examiner* — Jose Fortuna
(74) *Attorney, Agent, or Firm* — Michael W. Goltry; Robert A. Parsons; Parsons & Goltry

(57) ABSTRACT

A hydrophobic paper or cardboard that has self-assembled silicon-oxide nanoparticles with functional silane groups
(Continued)

and fluorocarbonated compounds linked directly to cellulose fibers of at least one surfaces thereof, with a Cobb value of 8 to 25 g/m$^2$ and water contact angles of 100° to 140°, which can be used for packing foodstuffs. The hydrophobic paper or cardboard may be printed, is recyclable and exhibits improved adhesion in areas requiring adhesive bonding of paper or cardboard.

16 Claims, 13 Drawing Sheets

(51) Int. Cl.

| | |
|---|---|
| ***D21H 17/67*** | (2006.01) |
| ***D21H 21/16*** | (2006.01) |
| ***D21H 17/00*** | (2006.01) |
| ***D21H 11/00*** | (2006.01) |
| ***D21H 19/38*** | (2006.01) |
| ***D21H 21/52*** | (2006.01) |

(52) U.S. Cl.
CPC ..... *D21H 17/675* (2013.01); *D21H 17/72* (2013.01); *D21H 19/385* (2013.01); *D21H 21/16* (2013.01); *D21H 21/52* (2013.01)

(58) Field of Classification Search
CPC ..... D21H 17/68; D21H 19/40; D21H 17/67; D21H 11/16; D21H 17/06; D21H 17/11; D21H 23/48; D21H 23/50; C09D 1/00; B82Y 30/00; B31C 11/04; Y10S 977/902
See application file for complete search history.

(56) References Cited

U.S. PATENT DOCUMENTS

| | | | | |
|---|---|---|---|---|
| 6,187,143 | B1 * | 2/2001 | Juppo | D21H 21/16 106/238 |
| 6,830,657 | B1 * | 12/2004 | Betremieux | B01F 17/005 162/158 |
| 6,949,167 | B2 * | 9/2005 | Shannon | D21H 21/16 162/109 |
| 7,196,043 | B2 * | 3/2007 | Valpey, III | B08B 17/065 510/193 |
| 7,229,678 | B2 * | 6/2007 | Reighard | B32B 27/08 427/411 |
| 7,811,627 | B2 * | 10/2010 | Baker | B82Y 30/00 162/900 |
| 7,927,458 | B2 * | 4/2011 | Williams | D21H 23/26 162/135 |
| 7,943,234 | B2 * | 5/2011 | Lawin | C09D 5/00 428/323 |
| 8,007,638 | B2 * | 8/2011 | Baker | D21H 21/16 162/123 |
| 8,258,206 | B2 * | 9/2012 | Kanagasabapathy | C08K 3/36 523/175 |
| 8,785,556 | B2 * | 7/2014 | Brown | C09D 127/18 524/544 |
| 2002/0032254 | A1 * | 3/2002 | Haasmaa | A61K 9/284 524/47 |
| 2002/0069989 | A1 * | 6/2002 | Feret | C09J 151/003 162/168.1 |
| 2003/0012897 | A1 * | 1/2003 | Huffer | B31C 11/04 428/34.3 |
| 2003/0109617 | A1 * | 6/2003 | Niinikoski | C09C 1/021 524/425 |
| 2003/0211050 | A1 * | 11/2003 | Majeti | A61K 8/891 424/49 |
| 2008/0041542 | A1 * | 2/2008 | Gray | C08L 1/10 162/102 |
| 2008/0113188 | A1 * | 5/2008 | Shah | C08J 7/04 428/336 |
| 2008/0188154 | A1 * | 8/2008 | Leis | B32B 7/12 442/181 |
| 2008/0265222 | A1 * | 10/2008 | Ozersky | D21H 11/16 252/607 |
| 2009/0018249 | A1 * | 1/2009 | Kanagasabapathy | C09D 1/00 524/434 |
| 2009/0148653 | A1 * | 6/2009 | Brown | C08F 2/44 428/96 |
| 2009/0252884 | A1 * | 10/2009 | Hildenbrand | C09D 4/00 427/508 |
| 2009/0304996 | A1 * | 12/2009 | Kishikawa | B32B 5/16 428/141 |
| 2010/0003488 | A1 * | 1/2010 | Danzer | B32B 21/14 428/220 |
| 2010/0215894 | A1 * | 8/2010 | Iverson | B82Y 30/00 428/87 |
| 2010/0233468 | A1 * | 9/2010 | Ioelovich | C08B 15/02 428/326 |
| 2010/0311889 | A1 * | 12/2010 | Gane | D21H 19/56 524/427 |
| 2011/0008585 | A1 * | 1/2011 | Schuelke | B31F 1/2813 428/182 |
| 2011/0033663 | A1 * | 2/2011 | Svec | C08F 220/18 428/141 |
| 2011/0081509 | A1 * | 4/2011 | Chang | B65D 65/466 428/34.2 |
| 2012/0328875 | A1 * | 12/2012 | Schoneveld | B82Y 30/00 428/339 |
| 2015/0206747 | A1 * | 7/2015 | Coe-Sullivan | H01L 21/0271 438/478 |
| 2015/0330025 | A1 * | 11/2015 | Luna Marroquin | D21H 17/11 162/158 |

FOREIGN PATENT DOCUMENTS

| | | | | |
|---|---|---|---|---|
| CH | WO 2004035929 | A1 * | 4/2004 | D21H 19/82 |
| CH | WO 2010000476 | A1 * | 1/2010 | B05D 7/06 |
| DE | 102004014483 | A1 * | 10/2005 | A01N 25/10 |
| EP | 1736504 | A1 * | 12/2006 | B32B 27/10 |
| ES | WO 2012087092 | A1 * | 6/2012 | C08L 23/06 |
| ES | KR 20120103726 | A * | 9/2012 | B82Y 30/00 |
| ES | WO 2013154414 | A1 * | 10/2013 | D21H 17/11 |
| GB | WO 2008023170 | A1 * | 2/2008 | C03C 17/28 |
| JP | WO 2009084566 | A1 * | 7/2009 | C08B 15/02 |
| JP | 2009173909 | A * | 8/2009 | |
| SE | WO 2011059398 | A1 * | 5/2011 | C08L 1/02 |
| WO | WO 0076862 | A1 * | 12/2000 | B32B 27/10 |
| WO | WO 2009091406 | A1 * | 7/2009 | D21H 19/38 |

OTHER PUBLICATIONS

Rodriguez, Diana Marisol Pacheco, Aminosilane-Functionalized Cellulosic Polymers for Increased Carbon Dioxide Sorption, master's thesis, Georgia Institute of Technology, Aug. 13, 2010, USA.
Wang, Xiao-Dong Wang, Shen, Zheng-Xiang, Sang, Tian, Cheng, Xin-Bin, Li, Ming-Fang, Chen, Ling-Yan, Wang, Zhan-Shan, Preparation of spherical silica particles by Stöber process with high concentration of tetra-ethyl-orthosilicate, Journal of Colloid and Interface, Sep. 18, 2009, Science 341 (2010) 23-29 (2009), USA.
Lim, Sang-Noon, Hudson, Samuel M., Synthesis and antimicrobial activity of a water-soluble chitosan derivative with a fiber-reactive group, Carbohydrate Research 339 (2004) 313-319, 2004, USA.

* cited by examiner

HYDROPHOBIC PAPER OR CARDBOARD WITH SELF-ASSEMBLED NANOPARTICLES AND METHOD FOR THE PRODUCTION THEREOF

TECHNICAL FIELD OF THE INVENTION

The present invention relates to coating materials, more specifically to a method for producing a hydrophobic paper or cardboard with self-assembled silicon-oxide nanoparticles with functional silane groups and fluorocarbonated compounds, the self-assembled nanoparticles linked directly to the cellulose fibers of the paper or cardboard.

BACKGROUND OF THE INVENTION

Currently, there is a lot of food that needs to be packed or packaged for shipment using paper or board, however, due to the conservation of food it is necessary to keep it in refrigeration chambers within its packaging. The humidity and temperature conditions under refrigeration may cause a collapse of these packaging materials resulting in loss of stored products, or in an over specification of the board to achieve the required strength with consequent cost increases.

To avoid the deterioration of the packing material either paper or board due to the high humidity conditions, various chemical compositions were studied for applying coatings to prevent moisture passing through the fibers of the paper or board, thus extending their lifetime, increasing the protection of food packaging and reducing costs that may result from failure of the mechanical resistance of the packaging. Some types of coatings such as resins, polymers, copolymers, inorganic and organic compounds are commonly used for paper and board, however, they do not have high moisture resistance values.

The use of nanoparticles for this application represents a great economic advantage for these packages, since the interaction between the cellulose network and the coating nanoparticles can be increased through the incorporation of various functional groups to the nanoparticles, resulting in improved hydrophobic properties due to the chemical interactions between these and the organic matrix. Usually inorganic particles, such as the case of silicon oxide, have a surface with a lower compatibility with organic compounds, either polymers of the polyolefin type or ionics of the amides or amine type, paper fibers or other biopolymers. To achieve a major compatibility it is intended that the surface of the nanoparticles react through different methods, for example, by self-assembly with products containing groups that when reacting may be more compatible with polymers and allow for better hydrophobic properties. In other words, by chemically modification functional groups are added to the nanoparticle surface to allow a better incorporation or compatibility with organic products such as polymers or other material matrix such as paper.

This type of nanoparticles is proposed in the Spanish Patent ES2354545 A1, which suggests the use of functionalized nanomaterials in the production of nanocomposites, to obtain different functional properties.

Below are abstracts and references of patents granted, patent applications and scientific publications considered in the analysis of the prior art associated with hydrophobic coatings for use on paper and board.

The U.S. Pat. No. 7,943,234 entitled "Nanotextured super or ultra hydrophobic coatings" describes a super-hydrophobic or ultra-hydrophobic coating composition that includes a polymer which may be a homopolymer or a copolymer of polyalkylene, polyacrylate, polymethyl acrylate, polyester, polyamide, polyurethane, polyvinlyl arilene, polyvinyl ester, copolymer of polyvinlyl arilene/alkylene, polyalkylene oxide or combinations thereof with particles having an average size of 1 nm to 25 microns, so that it favors a water contact angle of approximately 120° and 150 or more. In particular, the particle is silica which has been pretreated with a silane.

U.S. Pat. No. 7,927,458 entitled "Paper articles exhibiting water resistance and method for making the same" refers to a process for preparing a sticking paper and board that incorporates in its process a compound comprising one or more hydrophobic polymers, wherein the hydrophobic polymers, the amount of such polymers and the weight ratio of starch and such polymer in the compound may be selected so that the paper and board exhibit a Cobb value less than or equal to 25 $g/m^2$ and a sticking paper or paperboard produced by the process.

U.S. Pat. No. 7,229,678 entitled "Barrier laminate structure for packaging beverages" describes a laminated packaging material which comprises from a first outer layer of a polymer of low density polyethylene, a board substrate, a first layer of inner laminated nylon lining with a resin bonding layer, an extrusion blown layer comprising a first layer of low density polyethylene polymer, a bonding layer, a first inner layer of EVOH, a second bonding layer, a second interior layer of EVOH, a third bonding layer, and a second inner layer of low density polyethylene polymer, and an innermost layer that is in contact with a product of low density polyethylene.

U.S. Pat. No. 6,949,167 entitled "Tissue products having uniformly deposited hydrophobic additives and controlled wettability" describe products containing a hydrophobic additive such as a polysiloxane. Additionally, paper products are further treated with a wetting agent.

U.S. Pat. No. 6,830,657 entitled "Hydrophobic cationic dispersions stabilized by low molecular weight maleimide copolymers, for paper sizing" refers to a method for preparing an aqueous dispersion of a hydrophobic polymer dispersed as particles with an average diameter smaller than 100 nm, stabilized only by a macromolecular surfactant based on an imide anhydride styrene/maleic copolymer of low molecular weight. It also refers to the use of said dispersion in the treatment of paper.

U.S. Pat. No. 6,187,143 entitled "Process for the manufacture of hydrophobic paper or hydrophobic board, and a sizing composition" refers to a process for the manufacture of hydrophobic paper or board by gluing colofine resin, a complex organic agent that is used together with the colofine resin. It also refers to a gluing composition. After the application of the hydrophobic additive on one or more surfaces of the base sheet, the wetting agent improves the wettability properties of the base sheet.

U.S. Pat. No. 5,624,471 entitled "Waterproof paper-backed coated abrasives" describes a waterproof paper coated abrasive made in a gluing machine comprising a binding agent curable by radiation which is hydrophobic when polymerized.

U.S. Pat. No. 4,268,069 entitled "Paper coated with a microcapsular coating composition containing a hydrophobic silica" describes a coating composition comprising oil containing microcapsules dispersed in a continuous aqueous phase, which also contains particles of finely divided silica phase and a binding agent for said microcapsules and said silica particles. The silica particles have been treated with an organic material such as an organic silicon compound to give the particles a hydrophobic surface. The coating composition is useful in the manufacture of paper coated with microcapsules. Such paper is characterized by a substantial reduction of the specking when used in photocopiers that use a pressure contact line to assist in transferring the powder image of a photoreceptor belt to the paper.

The patent application US20110008585 entitled "Water-resistant corrugated paperboard and method of preparing the same" describes a method for preparing waterproof corrugated board consisting of a corrugated medium treated with a hydrophobic agent on both sides and a lining treated with a hydrophobic agent on at least one surface side. The lining and corrugated medium are bonded by an adhesive prepared with a carrier of starch, raw starch, borax, a hydrophobic resin, an additive to improve penetration and water. The starch carrier is composed of cooked and raw starch. The lining and corrugated medium are treated with the hydrophobic agent before being glued. Hydrophobic resins include resorcinol formaldehyde and urea formaldehyde resins.

The patent application US20110081509A1 entitled "Degradable heat insulation container" describes a container including a container body made of paper, a waterproof layer and a layer of foam. The container body has an outer surface and an inner surface. The waterproofing layer is coated on the inner surface. The waterproofing layer is mainly composed of powdered talc, and calcium carbonate resin. The foam layer is disposed over at least a portion of the outer surface. The foam layer comprises reinforcements and a thermo-expandable powder. The binding agent is selected from a group consisting of polyvinyl acetate resin, ethylene resin, vinyl acetate resin, polyacrylic acid resin, and a mixture thereof. The thermo-expandable powder comprises a plurality of thermo-expandable microcapsules, each of which comprises a thermoplastic polymer shell and a solvent of low boiling point due to its thermoplastic polymer shell.

The patent application US20110033663 entitled "Superhydrophobic and superhydrophilic materials, surfaces and methods" describes a generally applicable method that requires no more than one step which facilitates the preparation of superhydrophobic or superhydrophilic surfaces of a large area on a variety of substrates such such as glass, metal, plastic, paper, wood, concrete, and masonry. The technique involves free radical polymerization of common acrylic or styrenic monomers in the presence of porogenic solvent in a mold or on a free surface.

The patent application US20100233468 entitled "Biodegradable nano-composition for application of protective coatings onto natural materials" refers to a method for producing a biodegradable composition containing cellulose nanoparticles to form a protective coating on natural materials. One of its objects is to provide a composition to form a protective coating layer on a natural biodegradable material which provides water resistance and grease resistance to the material. Another object is to provide a composition to form a protective layer to natural biodegradable materials based on the use of cellulose nanoparticles and protects these materials from swelling, deformations and mechanical damage during contact with water, other aqueous liquids, or fats.

The patent application US20100311889 entitled "Method for manufacturing a coating slip, using an acrylic thickener with a branched hydrophobic chain, and the slip Obtained" is a method for manufacturing a coated paper sheet containing a mineral material, using as an agent to thicken the sheet, a water-soluble polymer comprising at least one unsaturated ethylene anionic monomer and at least one unsaturated ethylene oxyalkyl monomer ending in a hydrophobic alkyl, alkaryl, arylalkyl chain, aryl, saturated or unsaturated, branched with 14 to 21 carbon atoms and two branches each, containing at least six carbon atoms. The polymer is added to the sheet either directly or in a previous stage when the mineral material is ground, dispersed or concentrated in water, which may or may not be followed by a drying step. Thus, the water retention of the barbotine is improved, contributing to improved printability of the coated paper sheet.

The patent application US20080188154 entitled "Film laminate" describes a laminate including at least one layer of environmentally degradable film, such as a polylactide ("PLA") made from a readily available annually renewable polymer, from such resources as corn. A second layer may be a substrate made of, for example, paper, woven or non-woven fabric, or metal sheets. Environmentally degradable film and the substrate are adhered together by, for example, extruded polymers or adhesives such as water-based, hot melt, solvent or without solvent adhesives. The choice of the adhesive depends on the type of substrate to be laminated with environmentally degradable film and the desired properties of the resulting laminated composite structure (i.e., the "laminate"). The first layer is coated with a liquid polymer, a dispersion of nano-particles, a metal deposition or a silicone oxide deposition such that the gas permeability of the first layer is reduced. Said film laminates are used, for example, in packaging, envelopes, labels and forms printing, commercial publications, and in the digital printing industry.

The patent application US20080265222A1 entitled "Cellulose-Containing Filling Material for Paper, Tissue, or Board Products, Method for the Production Thereof, Paper, Tissue, or Cardboard Product Containing Such a Filling Material, or Dry Mixture Used Therefor" describes the surface modification of cellulose fibers with the application of nanoparticles to produce paper and packaging board. The advantage is in production and product recycling. Moreover, other different advantages are its acting as moisture repellent, adding whiteness and brightness to paper and board, biosida, antistatic and flame retardant. Nanodispersed cellulose and in combination with other components such as adhesives, polyvinyl sheets, flocculants, nanoparticle systems (not mentioned), polymers, anti-slip additives, an additive for fixation of the pigment, bleaches, defoamers, or preservatives.

The patent application US20080113188 entitled "Hydrophobic organic-inorganic hybrid silane coatings" describes a hydrophobic coating that may be formed from a solution that includes, for example, organically modified silicates mixed with coupling agents. Specifically, a sol-gel solution can be formed (i.e., at room temperature) which includes a plurality of alkoxysilane precursors containing at least one alkoxysilane glycidoxy precursor. The sol-gel solution may be a sol-gel mixed solution formed including by a first solution mixed with a second solution. The first solution may include one or more alkoxysilane glycidoxy precursors, and the second solution may include at least one alkoxysilane glycidoxy precursor. A coupling agent can be added and reacted with the sol-gel solution (mixed) forming the coating solution that can be applied to a substrate that needs to be protected against corrosion or chemical and/or biological agents.

In patent application US20080041542 entitled "Cellulose composites comprising hydrophobic particles and their use in paper products" composite polymeric films are proposed, prepared by solvent deposition of a suspension of quantum dots (QDs) in a solution of cellulose triacetate (CTA). The films were strong and had the correct optical properties of the quantum dots. The images obtained by Transmission Electron Microscopy (TEM) of the films revealed that the quantum dots are well dispersed within the matrix of the CTA film. Selective alkaline hydrolysis of QD/CTA films in NaOH 0.1 N for 24 hours resulted in the conversion of CTA surface to a regenerated cellulose. The optical properties of the films were tested both before and after the hydrolysis reaction using fluorescence spectroscopy, and found generally unchanged. Cellulose surfaces of the films allows superficial incorporation of alkaline treated films in the paper sheets.

The patent application US20030211050 entitled "Compositions comprising anionic functionalized polyorganosiloxanes for hydrophobically modifying surfaces and enhancing delivery of active agents to surfaces treated therewith" describes compositions and methods for treating and modifying surfaces and for enhancing delivery of active agents to surfaces treated therewith, wherein the compositions comprise siloxane polymers functionalized with outstanding fractions comprising two or more anionic groups, at least one anionic group which can be a carboxy group. When applied to a suitable surface, the present composition forms a layer of syloxane-anionic polymer substantially functionalized hydrophobic on the surface treated.

The patent application US20030012897 entitled "Liquid-resistant paperboard tube, and method and apparatus for making same" refers to a cardboard tube that becomes resistant to liquids by partial or complete coating of the tube with submicron-sized particles of inorganic materials treated to be hydrophobic and/or oleophobic. These particles can be applied directly to the board, settling in the surface pores such that the particles adhere to the board. Alternatively, a thin layer of a sticky binding agent or adhesive may be applied first to the board, and then the particles can be applied to adhere to the binding agent. Suitably, the particles have a large surface area per gram; in one embodiment, for example, the silica particles are employed having a surface area of about 90-130 $m^2/g$. As a result, the particles create a surface on the board that is highly repellant to liquids.

The patent application US20030109617 entitled "Method for pretreatment of filler, modified filler with a hydrophobic polymer and use of the hydrophobic polymer" describes a modified filler used in the manufacture of paper or the like, the preparation of filler material and its use. The modified filler comprises a known filler such as calcium carbonate, kaolin, talc, titanium dioxide, sodium silicate and aluminum trihydrate or mixtures thereof, and a hydrophobic polymer made of polymerisable monomers, which is added to the filler as a polymer dispersion or a polymer solution.

The patent application US20020069989 entitled "Bonding of paper using latex-dispersions of copolymers made of hydrophobic monomers/polymers of styrene/maleic anhydride type of low molecular mass" describes latex dispersions used in formulations of a binder for paper which make it possible to obtain COBB acceptable values, even for printing and writing paper or wrapping paper made from recycling pulps or mechanically destined pulps.

The patent application US20020032254 entitled "Hydrophobic polymer dispersion and process for the preparation thereof" refers to a hydrophobic polymer dispersion and a solvent-free process for the preparation thereof. According to the invention, the dispersion contains starch ester, together with dispersion additives known as such. According to the process, the polymer is first mixed with a plasticizer to obtain a plasticized polymer blend. The plasticized polymer blend is then mixed with dispersion additives and water at an elevated temperature to form a dispersion. Plasticizing the polymer and the dispersion of the mixture in water can be performed in an extruder. The dispersion obtained is homogenized in order to improve its stability. The dispersion obtained by the invention can be used for coating paper or board, such as a base or a component of paint or adhesive labels, and is also suitable for the production of deposited films and as a binder in materials based on cellulose fibers, as well as for medicinal coating preparations.

The patent application WO2011059398A1 entitled "Strong nanopaper" refers to a nanopaper comprising clay and microfibrillated cellulose nanofibers in which the MFC nanofibers and the clay layers are substantially oriented parallel to the paper surface. The invention further refers to a method for manufacturing the nanopaper and its use.

The patent application WO2009091406A1 entitled "Coated paperboard with enhanced compressibility" refers to a coated paperboard with improved compressibility, which enables improved softness at a low surface pressure. The compressible coating is based on nanofibers having a diameter less than 1000 nm. One of the claims is that the rate of PakerPrint smootheness increases 1.2 units when the surface pressure increases 5 to 10 $kgf/cm^2$. The procedure applies as described in TAPPI T555 om-99. The nanofibers can be: 1). Biopolymers: natural polymer, chitosan, a bicompatible polymer, polycaprolactone, polyethylene oxide, and combinations thereof. 2). Inorganic compounds: silica, aluminosilicates, $TiO_2$, TiN, $Nb_2O_5$, $Ta_2O_5$, TiN oxide, among others. 3). Resins: such as polyester, cellulose ether and ester, polyacrylic resin, polysulphur, copolymers, etc. These nanofibers are in combination with a binder which may be a polymer selected from the group of polyvinyl alcohol, polyvinylpyrrolidone, and combinations thereof. The nanofibers can be improved by adding oleophobic and hydrophobic additives that can be compounded with fluorocarbon groups.

The patent application WO2008023170A1 entitled "Tailored control of surface properties by chemical modification" discloses a process for producing a polymer or an inorganic substrate which is capable of adhering more than one material by the functionalization of the surface linking to the substrate by a carbon precursor. Nanoparticles (fullerene C60 or nanotubes) present in an adhesive system comprising a polymer which can be selected from polyolefins, polyesters, epoxy resins, polyacrylates, polyacrylics, polyamides, polytetrafluoroethylene, polyglycosides, polypeptides, polycarbonates, polyethers, polyketones, rubbers, polyurethanes, polysulfones, polyvinyls, cellulose, and block copolymers.

The patent application WO2004035929A1 entitled "Method of producing a multilayer coated substrate having improved barrier properties" describes the production of a coated substrate that is forming a multilayer composite of free flow, with at least two layers with a different barrier function, and the contact mechanism of the compound to the substrate. The number of layers required will depend on the anti-barrier function. Laminar nanoparticles (not mentioned) which are immersed in a binding agent may be styrene-butadiene latex, acrylic styrene, acrylonitrile latex, maleic anhydride latex, polysaccharides, proteins, polyvinylpyrrolidone, polyvinyl alcohol, polyvinyl acetate, cellulose and its derivatives, among others. Claims for the coated substrate are: 1). Vapor transmission rate of less than 50 $g/(m^2/day)$. 2). Cobb value 10 minutes less than 20 $g/m^2$. 3). Oxygen transmission value less than 200 $cm^3/(m^2/d/bar)$ (1 atm, 23° C., 90% relative humidity).

The patent application WO2003078734A1 entitled "Composition for surface treatment of paper" describes a surface treatment of paper and cardboard with mixtures of inorganic nanoparticles and organic pigments in plate form, in an aqueous solution that act as hydrophobic agent, anti-foaming, whitening, improve paper print quality, and is also inexpensive. Silica nanoparticles and precipitated $CaCO_3$, or mixtures of both. The nanoparticles are dispersed in latex (polymer) selected from the group: Butadiene-styrene, acrylate, styrene acrylate, polyvinyl acetate, and mixtures thereof.

The patent applications WO0076862A1 and ES2304963T3 entitled "Multilayer laminate structure of resin/paper, which contains at least one layer of polymer/nanoclay compound and packaging materials made thereof" describe a laminated structure for packaging and other applications than packaging, comprising: a paper substrate and at least one layer of polymer/nanoclay, comprising nanoclay particles with a thickness ranging from 0.7 to 9.0 nanometers applied to said paper substrate (4), wherein said layer of polymer/nanoclay compound consists of a mixture of a polymer resin with a barrier effect and a nanoclay, wherein said nanoclay is dispersed in the barrier polymer resin on a nanometer scale, and the amount of nanoclay in the composite layer represents from 0.5 to 7.0% in weight of the composite layer.

The patent CN1449913A entitled "Nano particle waterproof corrugated paper board" describes a corrugated waterproof paper. It consists of several layers of lined kraft cardboard and corrugated papers as raw materials that are placed between the Kraft liner sheets, respectively Said Kraft sheets and the raw materials are subjected to the process of oil immersion and to the treatment of moisture resistance, and subsequently protected by a microparticulate adhesive containing nano-calcium carbonate.

The patent application CN101623853A entitled "Full resin waterproof sand paper" describes a waterproof resin sandpaper, comprising six layers of an abrasive layer, an adhesive layer, a base layer for the adhesive, a surface layer of treated sandpaper, an original sandpaper layer, and a layer that is waterproof treated from top to bottom; wherein the adhesive layer is a mixture of urea formaldehyde resin, red iron and ammonium chloride, the base adhesive layer is a mixture of water-soluble acrylic resin, ammonium resin, fluoride and red iron; the treated surface layer of the sandpaper is a blend of latex rubber of nanometric styrene-butadiene, a solution of modified starch, water and penetrant JFS agent; the layer of waterproof treatment is a mixture of nanometric styrene-butadiene latex, a solution of modified starch, and a JFS penetrating agent.

The patent CN2871192Y entitled "The environmental protective decoration paper material", describes a type of paper material for decoration and protection of the environment, which comprises corrugated cardboard on which a nano waterproof layer was set. The former corrugated cardboard is made of corrugated BE cardboard, and may have one or several BE cardboard sheets. The invention not only has the water- or flame-resistant functions, but also offers environmental protection and a low price.

The patent CN2557325Y entitled "Nano particle water-resistant corrugated board" describes a nano-particulate corrugated water-resistant cardboard by using the technology of nano-level calcium carbonate particles. The invention includes a plurality of layers of corrugated cardboard and leather, arranged between the leather layers. Leather layers and corrugated cardboard are joined by a link of calcium carbonate nanoparticles. The utility of the invention is directed to food packaging and transportation of large goods.

The patent application DE102004014483A1 entitled "Coating composition, useful for antimicrobially coating and providing antimicrobial properties to substrates (i.e., papers, textiles), comprises porous inorganic coating contained in a homogenous distribution and a cationic polysaccharide" describes an antimicrobial polymer coating whose matrix incorporates inorganic oxides improving the mechanical and antimicrobial properties. Said coating can be applied on substrates of paper or fabric and comprises an inorganic porous layer in a homogeneous distribution and a cationic polysaccharide. Nanosol $SiO_2$, which is distributed evenly across a cationic polysaccharide.

The patent application JP2009173909A entitled "Process for production of cellulose nanofiber, and catalyst for oxidation of cellulose" mentions nanocellulose production from 4-hydroxy tempo derivatives which provide hydrophobicity.

The patent application JP2001163371A entitled "Packaging body having inorganic compound layer" refers to a method for improving the barrier properties to gases for a bottling body which consists in covering the bottling body with a sol-gel or a nanocomposite to create a film on the surface of the container which improves the gas impermeability properties.

The patent EP1925732A1 entitled "Packaging material with a barrier coating" describes a packing material for solid or liquid assets that contain paper, board, cardboard, cloth, wool, wood items, natural cellulose, plastic or compounds, which comprises a moisture resistant layer and active polymers with suspended microparticles and/or microclay. An independent claim is a method of manufacture (A) of a linear polymer coating, which occurs after the preparation of the base material, or in the separation process.

The patent EP1736504A1 entitled "Barrier materials and method of making the same" describes the barrier properties of an impervious material to water soluble gases is improved if the material is mixed with calcium carbonate nanoparticles which have a size of 10 to 250 nanometers. The barrier material is in a substrate to provide a substrate having properties of gas impermeability. A layer of heat sealable material can be applied to the exposed surface of the barrier material. It also discloses a method for manufacturing the coated substrate. The substrate can be paper, cardboard or paperboard.

In the article entitled "Development of superhydrophobic coating on paperboard surface using the Liquid Flame Spray", Surface & Coatings Technology 205 (2010) 436-445, a method is described for generating nanoscale coatings in a continuous roll-to-roll process at atmospheric pressure. The nano-structured and transparent coating, based on titanium dioxide nanoparticles, was deposited successfully online under atmospheric conditions on pigment-coated cardboard using a thermal spray method called Liquid Flame Spray (LFS). The LFS coating process is described and the influences of process parameters on the quality of the coating are discussed. The nanocoating was investigated with a scanning electron microscopy of field emission scanning electrons (FEG-SEM), an atomic force microscope (AFM), a photoelectron spectroscope emitted by X-rays (XPS) and a measurement of water contact angle. The highest water contact angles on the surface of nano-coated cardboard were more than 160°. Falling water drops were able to bounce off the surface, which is illustrated with images of the high-speed video system. Despite the high hydrophobicity, the coating was of a sticky nature, creating high adhesion to the water drops as soon as the movement of the droplets was stopped. The nanocoating with complete coverage of the substrate occurred at line speeds up to 150 m/min. Therefore, the coating on the LFS shall expand the potential to an industrial level as an economical and efficient method for coating large volumes at high speed on line.

The article "Adjustable wettability of paperboard by liquid flame spray nanoparticle deposition", Applied Surface Science 257 (2011) 1911-1917, describes the use of the process Liquid Flame Spray (LFS) for depositing nanoparticles TiOx and SiOx on cardboard to control the wetting properties of the surface. In the LFS process it is possible to create superhydrophobic or superhydrophilic surfaces. Changes in humidity are related to the structural properties of the surface, which were characterized by scanning electron microscopy (SEM) and an atomic force microscope (AFM). The surface properties can be assigned as a correlation between the properties of the cardboard moisture and surface texture created by the nanoparticles. The surfaces can be produced in line in a one-step process of roll-to-roll without further modifications. Moreover, the functional surfaces with adjustable hydrophilicity or hydrophobicity can be manufactured simply by choosing suitable precursor liquids.

The article "Modifications of paper and paperboard surfaces with a nanostructured polymer coating", Progress in Organic Coatings 69 (2010) 442-454, describes organic synthesized nanoparticles by imidization of styrene/maleic anhydride copolymers, are deposited as the first layer on paper and cardboard substrates of a stable aqueous dispersion containing solids up to 35% by weight. The morphology, physicochemical characteristics and surface properties of the coatings are discussed in this document, using scanning electron microscopy, atomic force microscopy, measurements of water contact angle and Raman spectroscopy. Due to the high glass transition temperature of the polymeric nanoparticles, a single micro-structured coating on nanoscale forms to promote gloss improvement, printing properties (inkjet printing test and off-set printing test), surface hydrophobicity (with a maximum water contact angle of 140°) and water repellency (reduced Cobb values). The interaction of nanoparticles layers with the cellulose paper results in improved mechanic strength of the paper, and is attributed to hydrogen bonding between the nanoparticles and the cellulosic fibers.

As can be seen, the products that have been used, in general, are nanoparticles (dispersed in polymeric substrates) such as calcium carbonate, silicon oxide, titanium oxide, carbon nanotubes, fullerenes, among others.

Cellulose nanofibers derivatived from 4-hydroxy TEMPO, nanofibres of biopolymers, inorganic nanofibers or resins, are another type of nanomaterials used in the manufacture of paper and/or cardboard with hydrophobic properties. In some scientific articles the use of certain treatments was found such as the application of oxides of silicon or titanium through the process "Liquid Flame Spray".

From the above and experimental evidence realized by the authors of the present invention, it is concluded that there are still opportunities for innovation and development of coatings based on nanoparticles enabling improved properties of paper and cardboard. For example, it is desirable that the coating after its application does not affect the printing of paper or cardboard, and it improves further the adhesion to the wings or bonding areas required by the cardboard boxes obtained. Moreover, it is desirable that the application of coatings on paper and cardboard do not prevent recycling of the corresponding packaging. From previous experiences with other products by the authors of the present patent application, it has also been found that the use of metal oxides such as silicon oxide, when not correctly functionalized require greater anchorage, and moreover, it is possible that they loosen with time causing the performance to be reduced during the handling of the packages.

To improve the performance of hydrophobic coatings on paper and cardboard, it is proposed in the present invention to use self-assembled silicon-oxide nanoparticles with silane based compounds and fluorocarbonated compounds, and alternatively the synergistic use of ultrasound to enhance the dispersibility of said silicon-oxide nanoparticles during their application on the fibers of at least one surface of the paper or cardboard.

SUMMARY OF THE INVENTION

In view of the aforementioned and with the aim of finding solutions to the limitations encountered, it is the object of the invention to provide a hydrophobic paper or cardboard with self-assembled silicon-oxide nanoparticles with functional silane groups and fluorocarbonated compounds, the self-assembled silicon-oxide nanoparticles linked directly to cellulose fibers on at least one of its surfaces.

It is also object of the present invention to provide a method to produce a hydrophobic paper or cardboard by the steps of preparing a dispersion of self-assembled silicon-oxide nanoparticles with functional silane groups and fluorcarbonated compounds in a hydro-alcoholized medium; applying the dispersion on at least one surface of the paper or cardboard; and drying and curing the paper or cardboard to directly link the self-assembled silicon-oxide nanoparticles with functional silane groups and the fluorcarbonated compounds to the cellulose fibers of the paper or cardboard.

BRIEF DESCRIPTION OF THE FIGURES

Other features of the present invention will become apparent from the following detailed description considered in connection with the accompanying drawings. It should be understood, however, that the drawings are made only as an illustration and not as a limitative definition of the invention, in which.

DETAILED DESCRIPTION OF THE INVENTION

Figure 1:
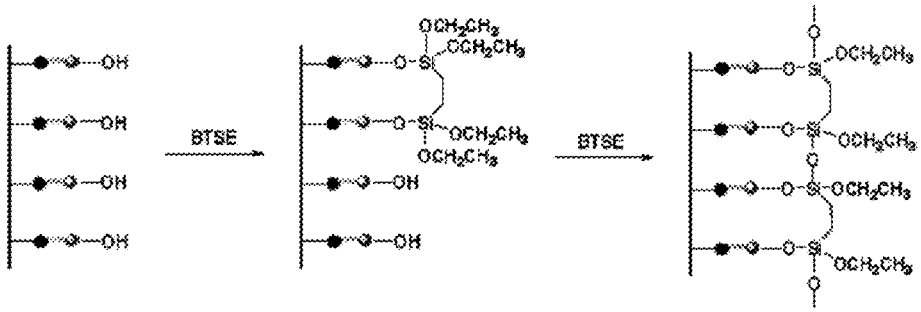
FIG. 1 shows a diagram of silane linking on the surface of silicon-oxide nanoparticles formed according to the invention.

The characteristic details of the invention are described in the following paragraphs together with the figures that accompany it, which are for the purpose of defining the invention but not limiting its scope.

The object of the present invention is to reduce the amount of water that can be absorbed by the paper or cardboard, once the fibers of at least one its surfaces has been coated with self-assembled silicon-oxide nanoparticles, and propose a new method of producing such paper or cardboard that achieves Cobb values between 8 and 25 $g/m^2$. The Cobb value indicates the capacity of water absorption by paper and cardboard, as well as the amount of liquid penetrating the same; that is, it indicates the weight of water absorbed in a specified time per 1 $m^2$ of paper or cardboard under normal conditions.

According to the present invention, hydrophobicity properties are conferred to the paper and cardboard through the use of coatings of self-assembled silicon-oxide nanoparticles and functionalized with fluorocarbonated compounds and groups such as functional silanes groups, in a colloidal hydro-alcoholized dispersion agitated by ultrasound.

Fluorocarbonated compounds used are for example: 2,3,5,6-tetrafluoro-4-methoxystyrene, monomers of acrylamide fluoridated, or 1H,1H,2H,2H-Perfluorooctyltrietoxysilane.

The functional silane groups used are: 3-Mercaptopropyltrimethoxysilane (MPTMS), 3-Glycidoxypropyltrimethoxysilane (GLYMO), Bis[3-(triethoxysilyl)propyl] tetrasulfide (TETRA-S), 1,2-Bis(triethoxysilyl)ethane (BTSE), dichlorodiphenylsilane, 3-isocyanatopropyltrimethoxysilane, 1,2-Bis (chlorodimethylsilyl)ethane, N-[3-(trimethoxysilyl)propyl]aniline, (3-Aminopropyl)triethoxysilane (APTES), 3-(Mercapto methyl)octyl)silane-triol, 2-(2-Mercaptoethyl) pentyl) silane-triol, Bis[3-(trimethoxysilyl)propyl] amine (BAS).

The hydrophobic characteristics of the coatings of self-assembled silicon-oxide nanoparticles on paper are maximized when the paper is immersed in hydro-alcoholic suspension and continuously agitated by some mechanical means, either supported by ultrasound or not, and the resulting coating is dried and cured at temperatures of about 80° C. to about 170° C. After applying the heat to evaporate the solvents in the dispersion and at the same time promote the anchorage or direct linking of the particles on the paper fibers, Cobb values can be obtained of about 8 $g/m^2$ to about 25 $g/m^2$.

This invention stands out from the above, because the application procedure of the coating does not affect the printing of paper or cardboard, further improving the adhesion on the wings or areas requiring gluing of the cardboard boxes obtained. Moreover, the coating application process, according to the present invention, on paper and cardboard does not prevent recycling of packaging and facilitates their adaptation to industrial machines for manufacturing boxes. The paper and cardboard products thus produced have high levels of moisture resistance and a high water contact angle-coating.

A fundamental concept when considering the use of hybrid or composite materials to achieve a particular functionality in a material as hydrophobicity of cellulose and its derivatives is compatibility between organic or polymeric materials and inorganic materials. This compatibility is usually characterized by a certain degree of antagonism, since many of the inorganic materials have a hydrophilic character, while polymers have a hydrophobic character. However, this property that can be antagonistic between the separate materials, can have a synergic effect in one sense or in the other as required in the hybrid or composite materials.

This situation means that an important part of the preparation of composite materials is focused on how to improve this compatibility by way of modifying the hydrophilic nature of the inorganic materials to achieve better linking of the inorganic material-organic matrix on the interfaces of both materials. So if we wish to take advantage of the barrier effect of the inorganic materials, these must be tightly bound to the matrix.

Adhesion between the inorganic materials and the polymer matrix can be attributed to a number of mechanisms that can occur on the interface, as isolated phenomena or as an interaction between them. The physical and chemical methods for modifying the interface, promote different levels of adhesion between the inorganic material and the polymer matrix. Physical treatments can change the structural and surface properties of inorganic aggregates, influencing the mechanical links with the polymer matrix. However, many highly polarized aggregates are incompatible with hydrophobic polymers. When two materials are incompatible, it is possible to introduce a third material called coupling agent, which has intermediate properties between the other two, and thus creates a degree of compatibility.

Chemical compounds containing methanol groups ($—CH_20H$) form stable covalent bonds with cellulose loads. Hydrogen linking between aggregate and matrix, can also be formed in this reaction.

The surface energy of the inorganic aggregate is closely related to the hydrophilicity and hydrophobicity of the composite materials. The silanes as coupling agents that may contribute to hydrophilic or hydrophobic properties of the interface. Organosilanes are the main group of coupling agents for polymers with glass or silicon oxide aggregates. Silanes have been developed to couple different polymers to the mineral aggregates in the manufacture of composite materials.

Coupling agents based on silane, can be represented by the following formula: $R—(CH_2)n\text{-}Si(OR')_3$, where n functional =0-3, OR' is a hydrolyzable alkoxy group, and R is the organic group.

The organic functional group (R) on the coupling agent produces the reaction with the polymer. Acts as a copolymerization agent and/or for the formation of an interpenetrating network. The alkaline silanes undergo hydrolysis in the step of forming links, both in an acid medium and in a basic medium. These reactions of silanes with the surface hydroxyls of the aggregates surface may lead to the formation of polysiloxane structures.

In the present invention, the use of self-assembly techniques is contemplated for the functionalization of silicon-oxide nanoparticles prior to their dispersion in a polymer matrix.

Self-assembly can be defined as the spontaneous formation of complex structures from smaller pre-designed units. The self-assembled monolayers are ordered molecular units which are formed by spontaneous absorption (chemisorption) of a surfactant onto a substrate, wherein the first a functional group with affinity to this substrate.

The reaction sequence of self-assembly is performed according to this invention with the purpose of preparing a hybrid material to assign paper or cardboard a hydrophobic character or resistance to water absorption as described below.

For the preparation of $SiO_2$ nanoparticles with the intention to generate dispersions in a hydro-alcoholic solution, TEOS was used as starting material dissolved in a mixture of ethanol-water and stabilized at a pH of about 3.5 to about 3.75; this is allowed to react at temperatures of about 25° C. to about 40° C. for approximately 15 minutes to approximately 90 minutes, forming a transparent or white colloidal solution.

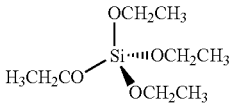

Subsequently, the TEOS tends to hydrolyze generating cores of formula $(SiO_2)x$

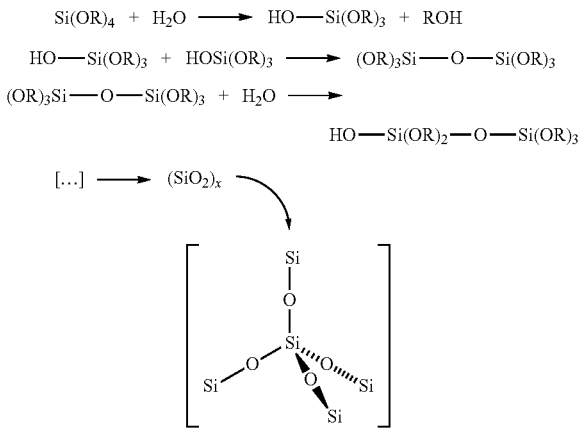

Other functional silanes groups were employed such as: 3-Mercaptopropyltrimethoxysilane (MPTMS), 3-Glycidoxypropyltrimethoxysilane (GLYMO), Bis[3-(triethoxysilyl)propyl] tetrasulfide (TETRA-S), 1,2-Bis(triethoxysilyl) ethane (BTSE), dichlorodiphenylsilane, 3-isocyanatopropyltrimethoxysilane, 1,2-Bis (chlorodimethylsilyl)ethane, N-[3-(trimethoxysilyl)propyl]aniline, (3-Aminopropyl)triethoxysilane (APTES), 3-(Mercapto methyl)octyl)silane-triol, 2-(2-Mercaptoethyl)pentyl) silane-triol, Bis[3-(trimethoxysilyl)propyl] amine (BAS), and combinations thereof, with the objective of substituting the hydroxyl groups and of generating functional groups on the silicon-oxide nanoparticles surface that are able of originating self-assembly reactions on the surfaces of the generated silicon oxide nanoparticle cores. FIG. 1 shows how these silanes can form links on the surface of the silicon-oxide nanoparticles that are formed.

The third stage of the synthesis process of silicon-oxide nanoparticles functionalized consists of the creation of the crust of the nanoparticles. The crust of these nanoparticles is formed of fluorocarbon chains of molecules. These crusts are prepared by polymerization reactions or condensation on the surface of the nanoparticle cores. Depending on the type of functional group, different molecules are used for fluorocarbon crust formation.

Figure 2:
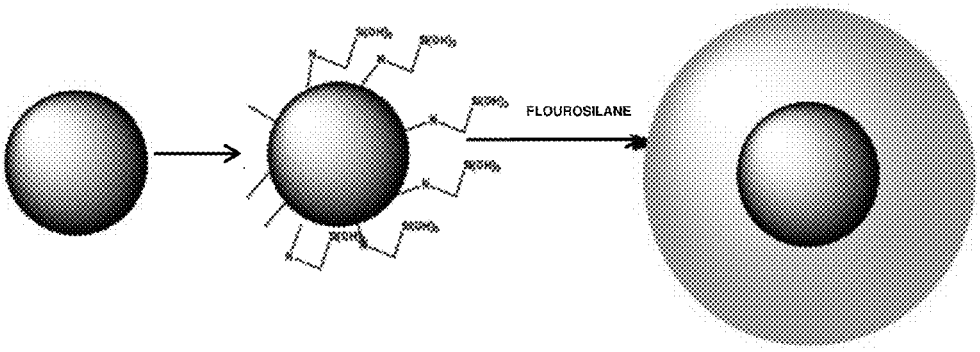
FIG. 2 shows a diagram of a crust by polymerizing fluorocarbonated compounds into nanoparticles according to the invention.

In some of these polymerizations, intervention is necessary of small amounts of catalysts; these catalysts are of an acid type, such as carboxyl groups, compounds of Cu(I), basic medium such as ammonia or potassium carbonate. A reaction scheme is shown in FIG. 2.

It is necessary to use a bis-silane, such as BAS, TETRA-S, or BTSE and the fluorocarbonated compound with functional silane groups. These reactions are performed at pH 3.5 and allowed to react during 30 minutes at 25° C. From these reactions in three stages, particles were prepared of sizes between 10 nm and 130 nm. Fluorocarbon groups were used such as 2,3,5,6-tetrafluoro-4-methoxystyrene, monomers of acrylamide fluoridated, or 1H,1H,2H,2H-Perfluorooctyltrietoxysilane. The silane groups used are: 3-Mercaptopropyltrimethoxysilane (MPTMS), 3-Glycidoxypropyltrimethoxysilane (GLYMO), Bis[3-(triethoxysilyl)propyl] tetrasulfide (TETRA-S), 1,2-Bis(triethoxysilyl)ethane (BTSE), dichlorodiphenylsilane, 3-isocyanatopropyltrimethoxysilane, 1,2-Bis (chlorodimethylsilyl)ethane, N-[3-(trimethoxysilyl)propyl]aniline, (3-Aminopropyl)triethoxysilane (APTES), 3-(Mercapto methyl)octyl)silane-triol, 2-(2-Mercaptoethyl) pentyl) silane-triol, Bis[3-(trimethoxysilyl)propyl] amine (BAS), and combinations thereof.

The former in order to avoid agglomeration and precipitation of the colloidal nanoparticles. In this invention, an alternative method is proposed by the use of ultrasound and the synergic effect of cavitation generated by ultrasound and self-assembly which prevents dispersed nanoparticles, once dispersed to re-agglomerate. Because of exerted repulsion between particles, in a suitable dispersion medium and due to surface functionalization of the same, it is possible to achieve a good dispersion of said particles, even at concentrations above 25%.

In general, ultrasonic dispersion is performed using an ultrasonic generator across one or more piezoelectric transducers that convert the electrical signal into a mechanical vibration. This vibrational energy is transmitted to the liquid at a rate of up to 200,000 oscillations per second. These oscillations of pressure and vacuum create a large amount of microbubbles, which implode at high speed to contribute to the disintegration of the clusters of nanoparticles.

The combined use of ultrasound and/or ultrasound pulses at frequencies of about 10 KHz to about 150 KHz, and at temperatures of about 10° C. to about 250° C. in aqueous or organic solvents results in the disintegration of the clusters of nanoparticles. Furthermore, the addition of molecules with ability to functionalize the nanoparticle surface by self-assembly, allows obtaining nanopowders with high disintegration of the particles in an ultrasonic bath, primarily due to the functional groups of the same that prevent these from being added due to electrostatic interactions between the nanoparticles. Furthermore, the functionalized autoassembled nanoparticles allow greater dispersion and prevent clusters of nanoparticles or aggregates from appearing.

The dispersion of the self-assembled nanoparticles is performed in a hydro-alcohilized medium, wherein the dispersion has a density of approximately 0.96 g/cm$^3$ to approximately 0.99 g/cm$^3$ and a pH from approximately 3 to approximately 4.5.

The alcohol used for preparing the dispersion may be ethanol, propanol, methanol, and combinations thereof.

Figure 3A:
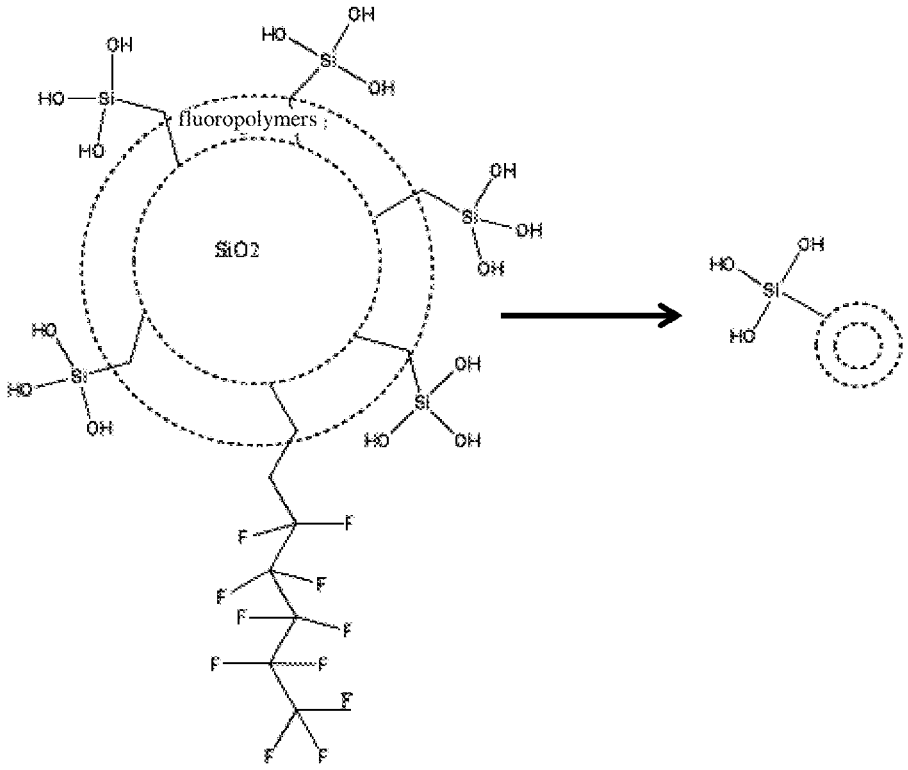
FIGS. 3A, 3B, and 3C show a diagram of physicochemical fixation of the silicon-oxide nanoparticles with the fibers of the paper or cardboard by dehydration of free silanol groups according to the invention.

Deposition of colloidal solutions of silicon-oxide nanoparticles on at least one surface of the paper or cardboard results in deposited nanoparticles, without these remaining fixated for any chemical or physicochemical interaction thereon, except a physical occlusion in the holes of the paper or cardboard. For physicochemical fixation of the silicon-oxide nanoparticles with the fibers of paper or cardboard with at least one of their outer surfaces, dehydration is required of the free silanol groups leading to a three-dimensional network as shown in FIG. 3A.

Figure 3B:
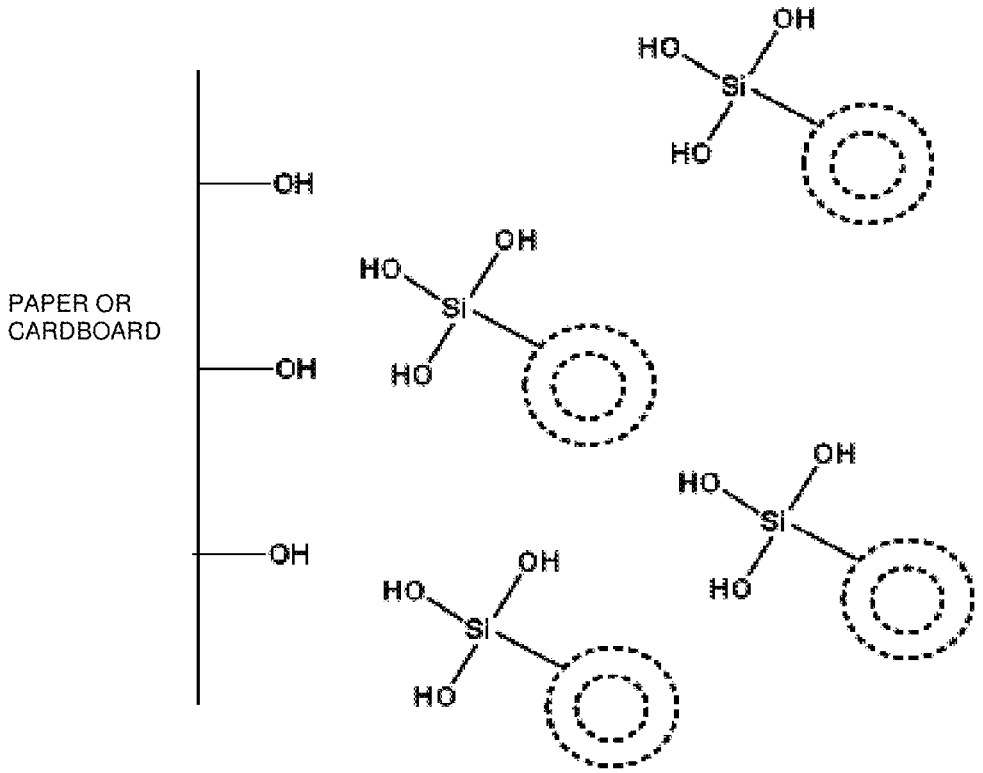
Figure 3C:
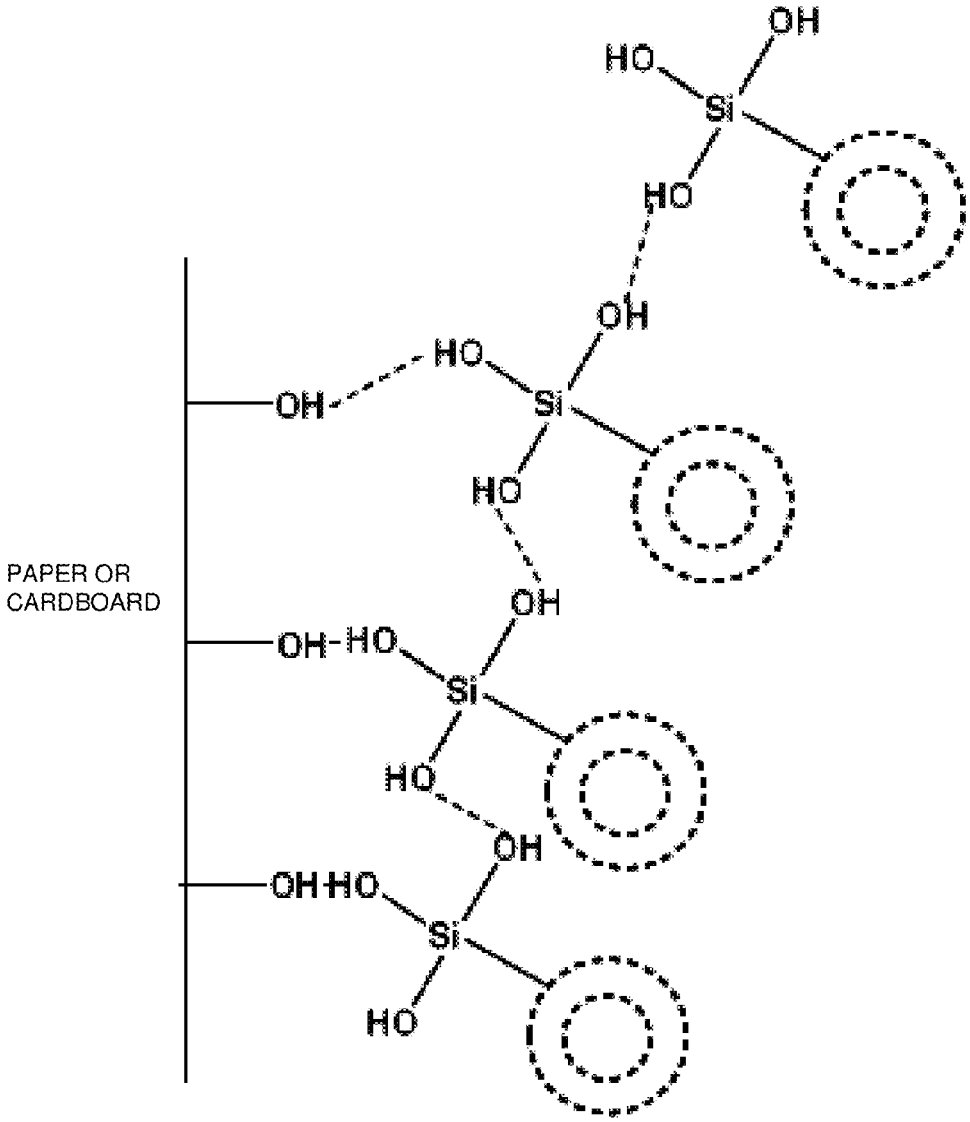

Subsequently, during the immersion-extraction process of the paper, the silanols migrate and deposit on the paper or cardboard as shown in FIGS. 3B and 3C. According to experimental tests carried out by the inventors and despite the functionalization of silicon-oxide nanoparticles, it is necessary to maintain good dispersion and prevent said nanoparticles from agglomerating in the container of the suspension of silicon-oxide nanoparticles. Generally, it is understood that the mixtures of organic polymers with inorganic or metallic particles give rise to a phase separation agglomeration of nanoparticles that subsequently results in poor properties. Moreover, when the particles have diameters below 50 nanometers, it is actually very difficult to obtain a homogeneous mixture if the added amount exceeds 5% by weight, or when polymers that are used have a high melt viscosity. For this reason we need new methods such as ultrasound to achieve these requirements in terms of dispersion.

Finally, a heat treatment achieves the polimerization of the coating.

This heat treatment is critical to obtain a superhydrophobic coating on the surface of paper or cardboard.

Figure 4:
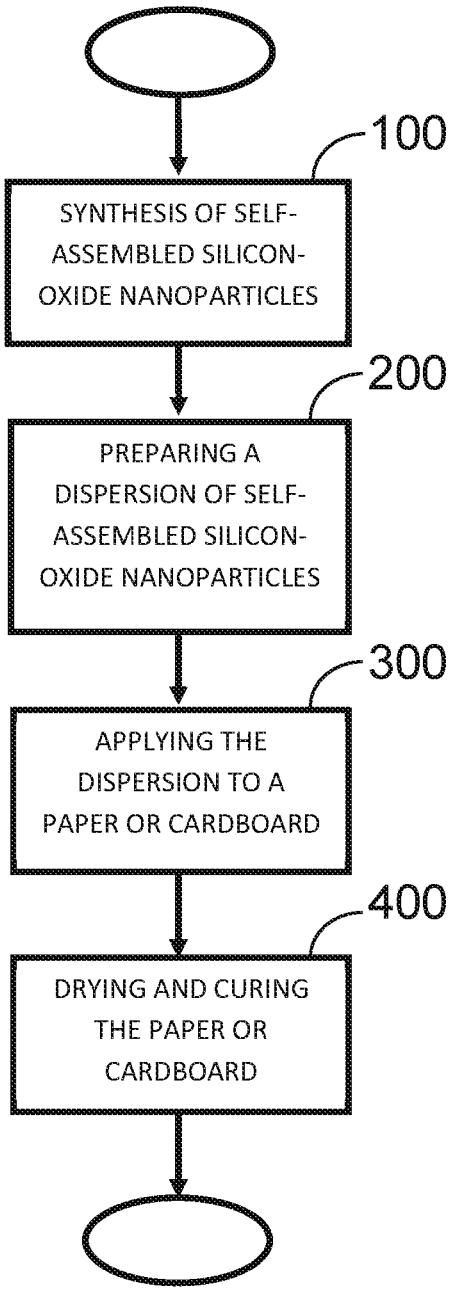
FIG. 4 shows a block diagram of the steps of the process of applying hydrophobic coatings on paper and cardboard, based on self-assembled silicon-oxide nanoparticles according to the present invention.

In summary, but not limiting the method to produce hydrophobic paper or paperboard of the present invention, the invention is shown schematically by the block diagram of FIG. 4 which indicates the stages of the method by different numbers and which are described below:

In step 100, alternatively, in case of not having the self-assembled nanaoparticles, a synthesis is performed by self-assembling the silicon-oxide nanoparticles with functional silane groups and the fluorocarbonated compounds in a hydro-alcoholized medium agitated by ultrasound.

In the present invention, self-assembled silicon-oxide nanoparticles functionalized with amine free functional silane groups and fluorocarboned compounds are used.

Once nanoparticles have been self-assembled, in step 200, a dispersion is prepared by mechanical stirring of the self-assembled silicon-oxide nanoparticles with functional silane groups and fluorcarbonated compounds in a hydro-alcoholized medium. The dispersion of the nanoparticles can be supported by the application of ultrasound with a continuous or pulsed frequency of approximately 10 KHz to approximately 150 KHz.

Once the dispersion is prepared, in step 300 the dispersion is applied on at least one surface of paper or cardboard, where the hydrophobic property is required. This application can be by immersion-extraction of the paper or cardboard in the dispersion of nanoparticles in order to react and link the Si—OH groups of the nanoparticles with the OH groups of the cellulose fibers of paper or cardboard. This application in turn can be dosed and distributed evenly on the surface of paper or paperboard by means of a scraper.

Finally, in step 400, the paper or cardboard is dried and cured to directly link the self-assembled silicon-oxide nanoparticles with functional silane groups, and fluorcarbonated compounds with the cellulose fibers of paper or cardboard.

It is important to note that although a skilled expert in the art may find that independently each of the stages belong to the prior state of the art, the synergic effect of all five steps comprising the method of application of nanoparticles, dispersed and functionalized according to the present invention, produces effects that are not formerly reported in the state of the art, and that if any of the steps set forth is not carried out it is not possible to obtain the hydrophobicity properties, nor coating improvements reported in the present invention.

As it has been observed experimentally, very important factors that directly affect the curing reactions of cardboard are time and temperature of the heat treatment, which have a close relationship with the crosslinking level of the active components of the coating, and consequently with Cobb values.

According to the above, it was observed that the longer and higher temperature of curing, the lower Cobb values of coatings are obtained.

As discussed previously, the process of curing and drying is key to obtain a superhydrophobic coatings on the surface of the paper or cardboard, that is, it is the heat which helps directly in the fixation of nanomaterials on the paper or cardboard surface, not only generating this linking with the fibers, but also promotes the interactions between the nanoparticles so as to produce a nanoparticle coating which enables nanostructured greater lotus effect, causing the paper to present a greater resistance to moisture.

As the cross-linking process between the fibers of paper or cardboard and applied nanoparticles is based on the dehydration of the functional groups Si—OH of fluorocarbon and —OH cellulose, the improvement of Cobb values depends directly on the dehydration process of said groups, and on the phenomenon of cross-linking of Si—OH groups and their interaction with cellulose fibers. This interaction makes a greater amount of these groups react and increase the linking of the silicon-oxide nanoparticles to the surface of each fiber, so that by increasing the temperature and the curing time an optimization of the cellulosic surface curing is achieved. During these thermal processes occurring at a temperature of approximately 80° C. to approximately 170° C., the paper or cardboard fiber loses a certain amount of chemically bound water, which after the curing process must be recovered to prevent destabilization in the fiber arrangement and rigidity.

Thus, it was determined that the curing conditions for preparing paper or cardboard of the present invention with Cobb values close to 20 g/m$^2$ correspond to a temperature of 150° C. and a time of 180 seconds by using an immersion time in the suspension of 10 seconds and coating amounts close to 3.5 g/m$^2$.

Just as for the curing temperature, excess of the heat treatment time results in a reduction of the humidity resistance values, which could be verified in tests at 170° C. for 240 seconds.

Figure 5:
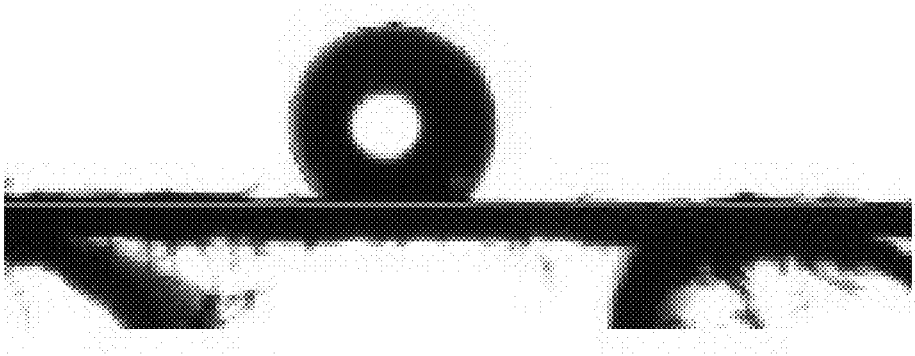
FIG. 5 shows a photograph of the water contact angle of the paper or cardboard of the present invention.
Figure 6:
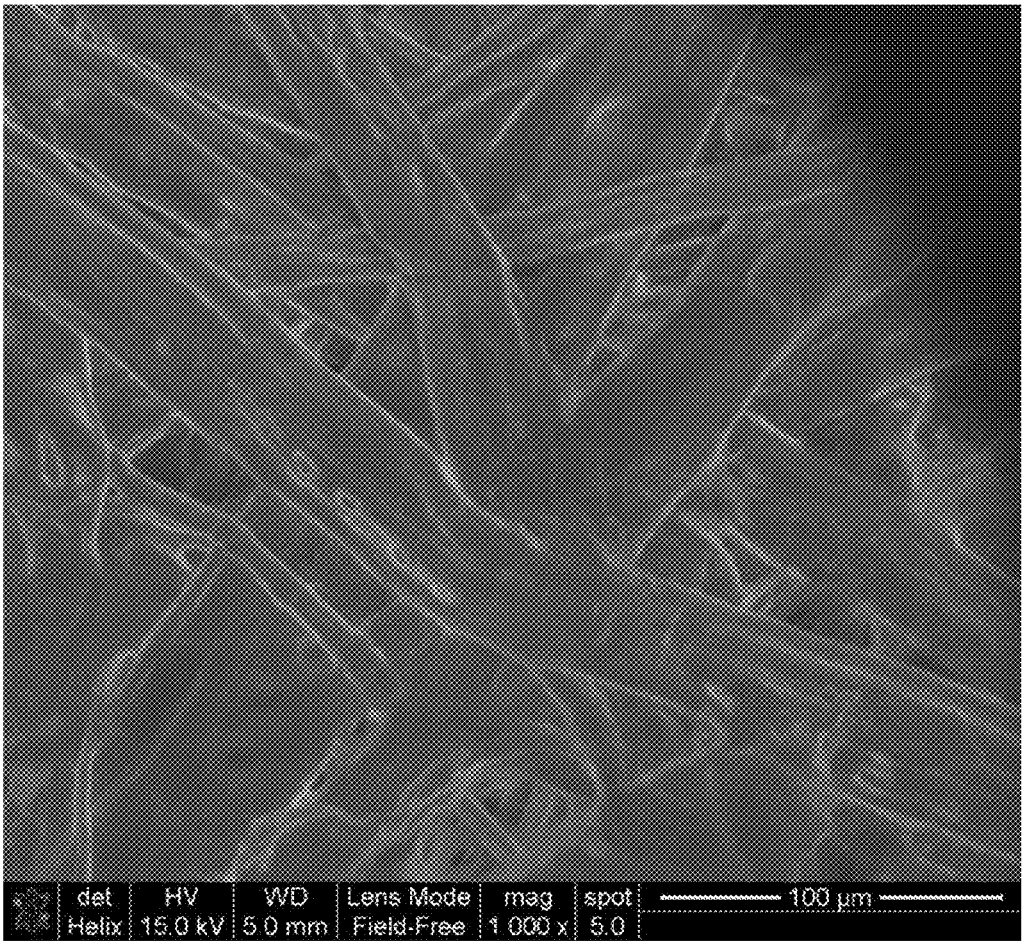
FIG. 6 shows a photomicrograph obtained by scanning electron microscopy of an uncoated paper or cardboard of the prior art, illustrating the cellulose fiber matrix.
Figure 7:
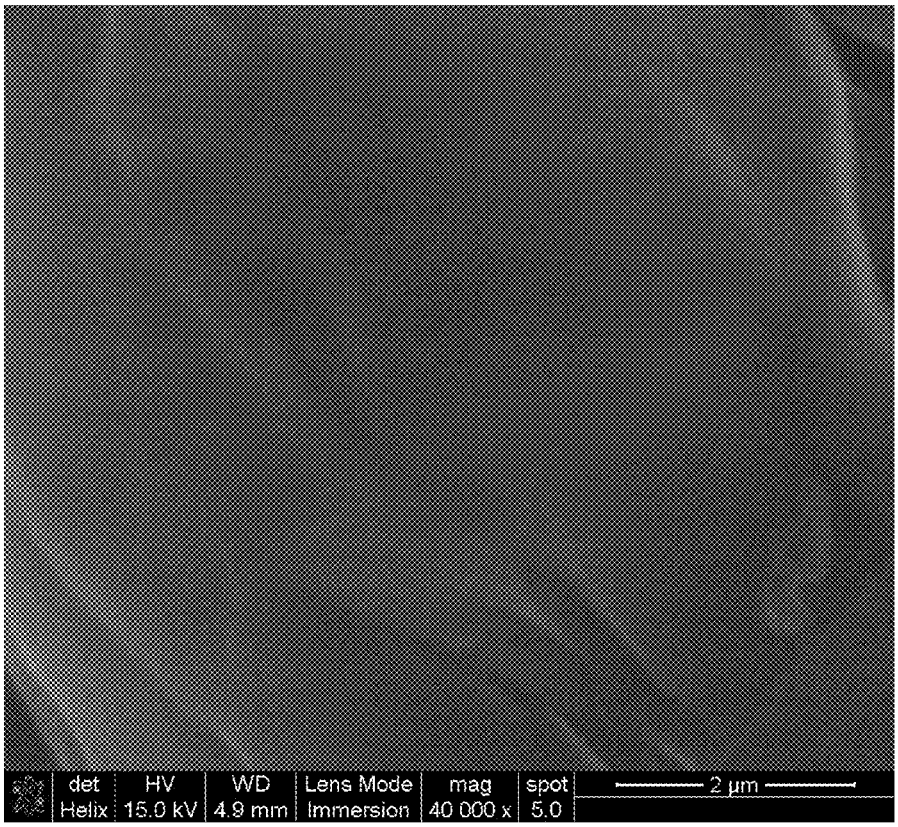
FIG. 7 shows a photomicrograph obtained by scanning electron microscopy of a cellulose fiber of an uncoated paper of the prior art.
Figure 8:
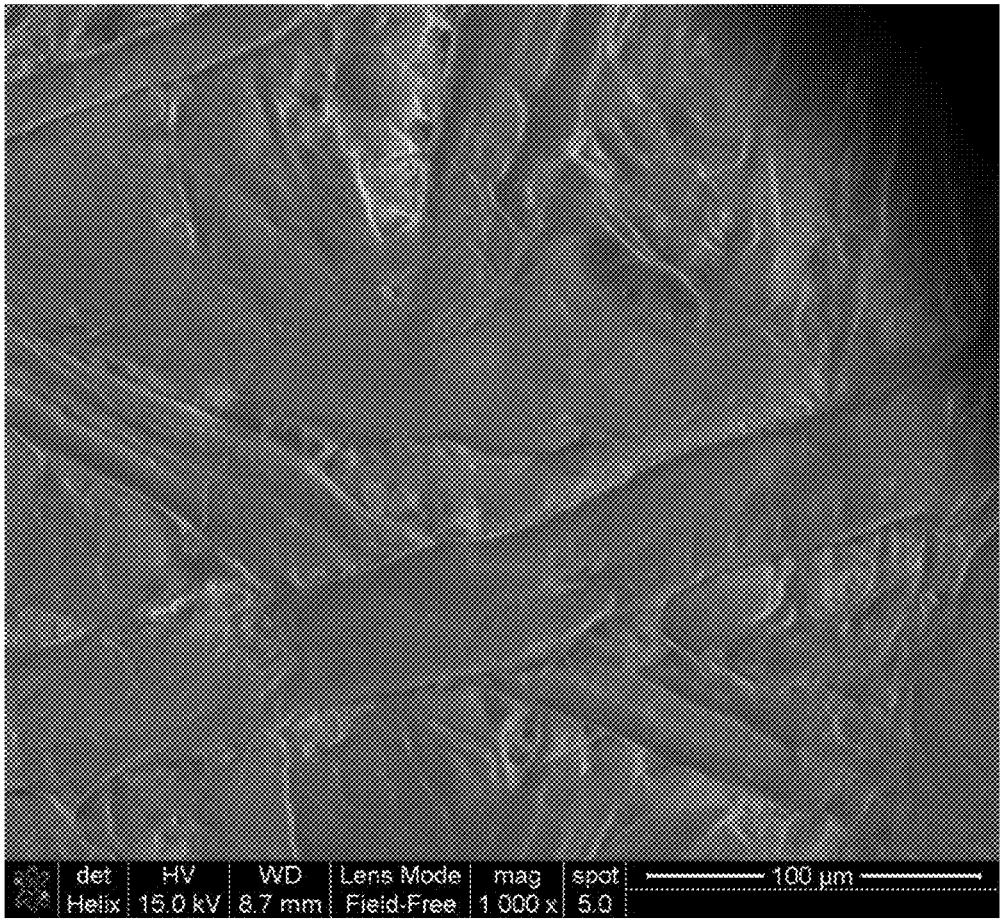
FIG. 8 shows a photomicrograph obtained by scanning electron microscopy of a paper or cardboard with a coating of the Michelman® type according to the prior art, where the cellulose fiber matrix is shown covered by a film-like coating.
Figure 9:
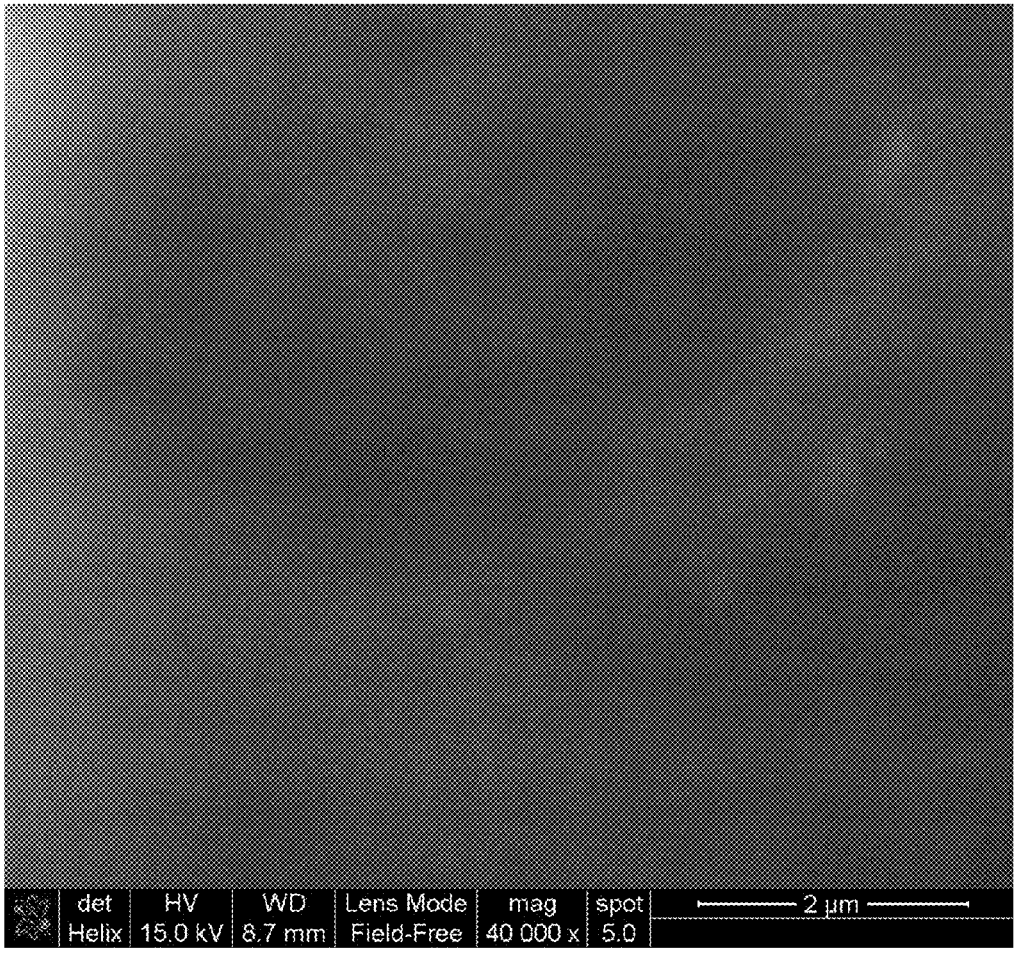
FIG. 9 shows a microphotograph obtained by scanning electron microscopy of a cellulose fiber of a paper or cardboard with a coating of the Michelman® type according to the prior art, where the film-like coating is shown as extending to other cellulose fibers.

The water contact angle with the surface with self-assembled nanoparticles on paper or cardboard of the present invention is approximately 100° to approximately 140° as illustrated in FIG. 5.

EXAMPLES OF EMBODIMENT OF THE INVENTION

The invention will now be described with respect to the following examples, which are solely for the purpose of representing the way of carrying out the implementation of the principles of the invention. The following examples are not intended to be an exhaustive representation of the invention, nor intended to limit the scope thereof.

For preparing hydrophobic coatings of self-assembled and functionalized silicon-oxide nanoparticles, according to the present invention, a colloidal hydro-alcoholized dispersion of nanoparticles was used with fluorocarbons with a density of 0.98 g/cm$^3$ and a pH of 3.6. This suspension was stirred with ultrasound for 30 minutes. After the stirring process the suspension was poured into a tray and the paper was started to be covered.

Two types of cardboard were prepared; one with a compressive strength of 220.63 kPa (32 lb/in$^2$), and one with a resistance of 303.37 kPa (44 lb/in$^2$). Both complied with the standardized method ECT. The composition of the cardboards for each case was as follows: Resistance of 32 ECT (Liner L33A, Midium M110U, Liner LT170) and resistance of 44 ECT (Liner L42A, Midium M150U, Liner LT170t).

Test 1. Paper of 44 ECT

Table 1 shows the temperature conditions of the different critical process parameters.

TABLE 1

| | Temperature ° C. |
|---|---|
| Cylinder | 170 |
| Paper cold part | 84 |
| Corrugator roll | 145 |
| Paper after cylinder | 105 |

The production rate was 80 m/min. In this test it was observed that when the dispersion is no longer stirred, the product in the tray is not homogeneous. Stirring was then started again. In that way it was possible to observe that the effect decreased and the product became homogeneous again.

Test 2. Paper of 44 ECT

Table 2 shows the temperature conditions of the different critical process parameters.

TABLE 2

| | Temperature ° C. |
|---|---|
| Cylinder | 170 |
| Paper cold part | 91 |
| Corrugator roll | 134 |
| Paper after cylinder | 116 |

The production rate was 60 m/min.

Test 3. Paper of 32 ECT

Table 3 shows the temperature conditions of the different critical process parameters.

TABLE 3

| | Temperature ° C. |
|---|---|
| Cylinder | 168 |
| Paper cold part | 93 |

TABLE 3-continued

| | Temperature ° C. |
|---|---|
| Corrugator roll | 167 |
| Paper after cylinder | 123 |

The production rate was 80 m/min.

With sheets of coated paper boxes were produced, which were manipulated such that the coating was obtained on the inner face and the outer face.

Table 4 shows a comparison of the Cobb values obtained, the contact angle, the passage speed of the water, and the amount of material used for each test.

TABLE 4

| | Water contact angle | | Water flow rate g/s | | Cobb gwater/m$^2$ | | Amount of material |
|---|---|---|---|---|---|---|---|
| Test | Paper | Cardboard | Paper | Cardboard | Paper | Cardboard | g/m$^2$ |
| 1 | 118.1 | 117.4 | 0.036 | 0.005 | 16.7 | 26.8 | 0.627 |
| 2 | 111.9 | 128.9 | 0.004 | 0.040 | 15 | 25.0 | 0.81 |
| 3 | 121.0 | 128.8 | 0.047 | 0.005 | 25 | 25.2 | 0.630 |

The amount of material per square meter is less than 1 g/m$^2$ in the tests in general, the best Cobb values are 15 for cardboard where water contact angles larger than 128° were obtained and low penetration of liquid. These water contact angles are far superior to those obtained with commercial coatings of the Michelman® type.

Is important to note that in commercially available coatings such as Michelman®, the amount of material required to achieve Cobb values between 25 and 30 is between 4 g/m$^2$ to 16 g/m$^2$.

Figure 10:
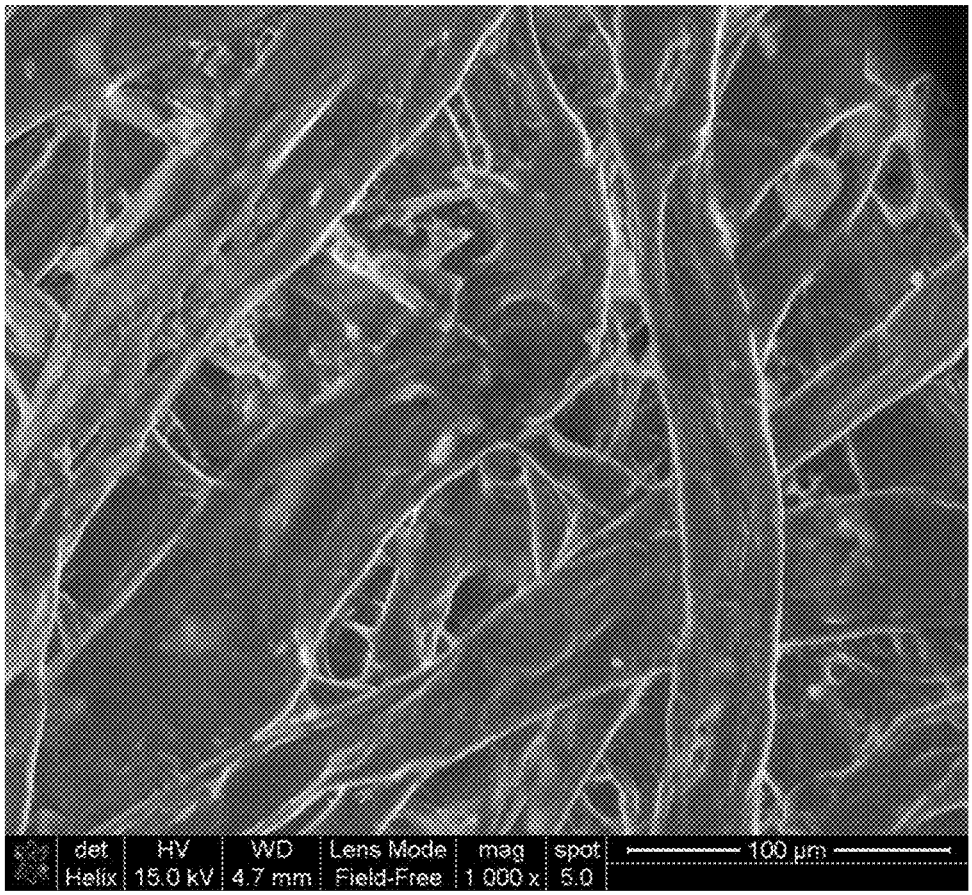
FIG. 10 shows a microphotograph obtained by scanning electron microscopy of a paper or cardboard with a coating according to the invention, wherein it is illustrated that there is no film formation on the matrix, but the cellulose fibers are coated.
Figure 11:
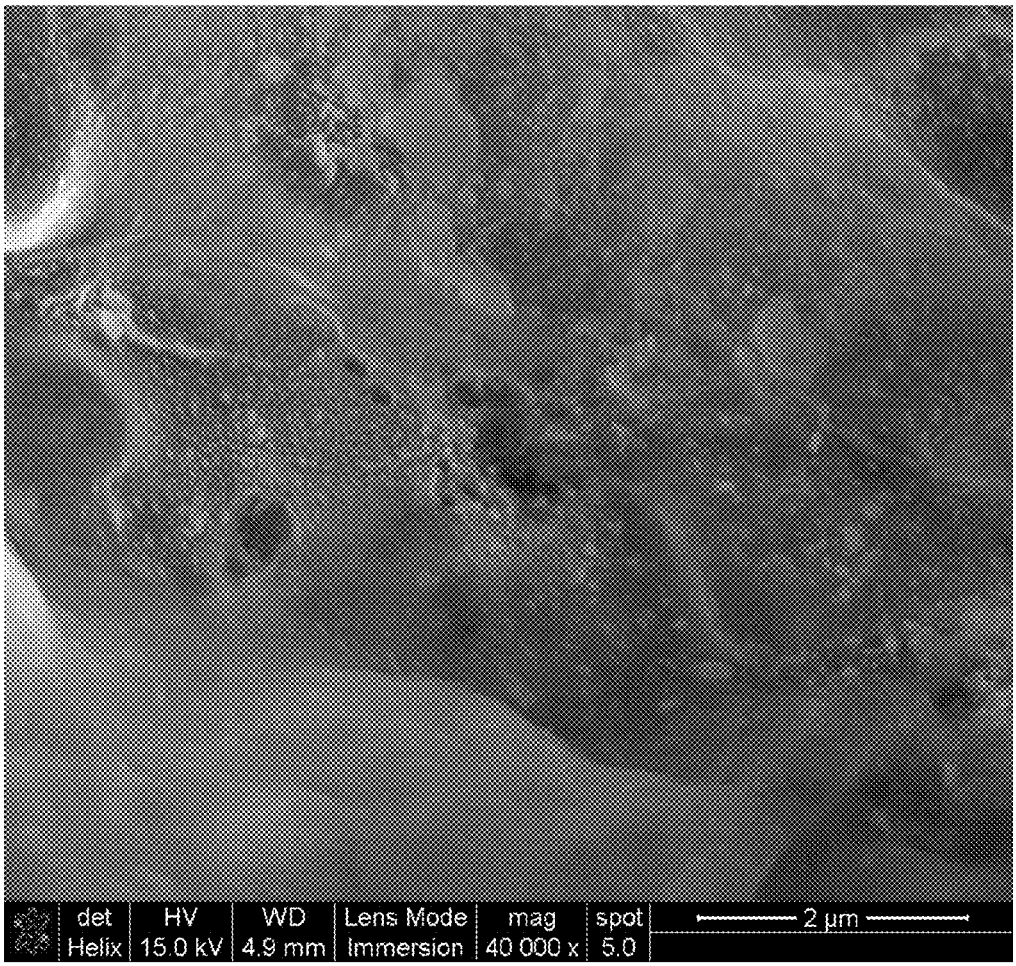
FIG. 11 shows a microphotograph obtained by scanning electron microscopy of a cellulose fiber of a paper or cardboard with a coating according to the invention, where the coating is shown on the cellulose fibers.

FIGS. 6 to 11 illustrate a photomicrograph obtained by scanning electron microscopy both for paper or cardboard of the prior art uncoated (see FIG. 6) and its corresponding details of cellulose fiber (see FIG. 7), paper or cardboard with a coating of the Michelman® type according to the prior art (see FIG. 8) and its corresponding details of cellulose fibers (see FIG. 9), as well as paper or cardboard with a coating according to the invention (see FIG. 10) and its corresponding details of cellulose fibers (see FIG. 11), so that one can observe the comparative effect between a film type coating (see FIGS. 8 and 9) with the effect of fiber coatings of the present invention (see FIGS. 10 and 11).

Figure 12:
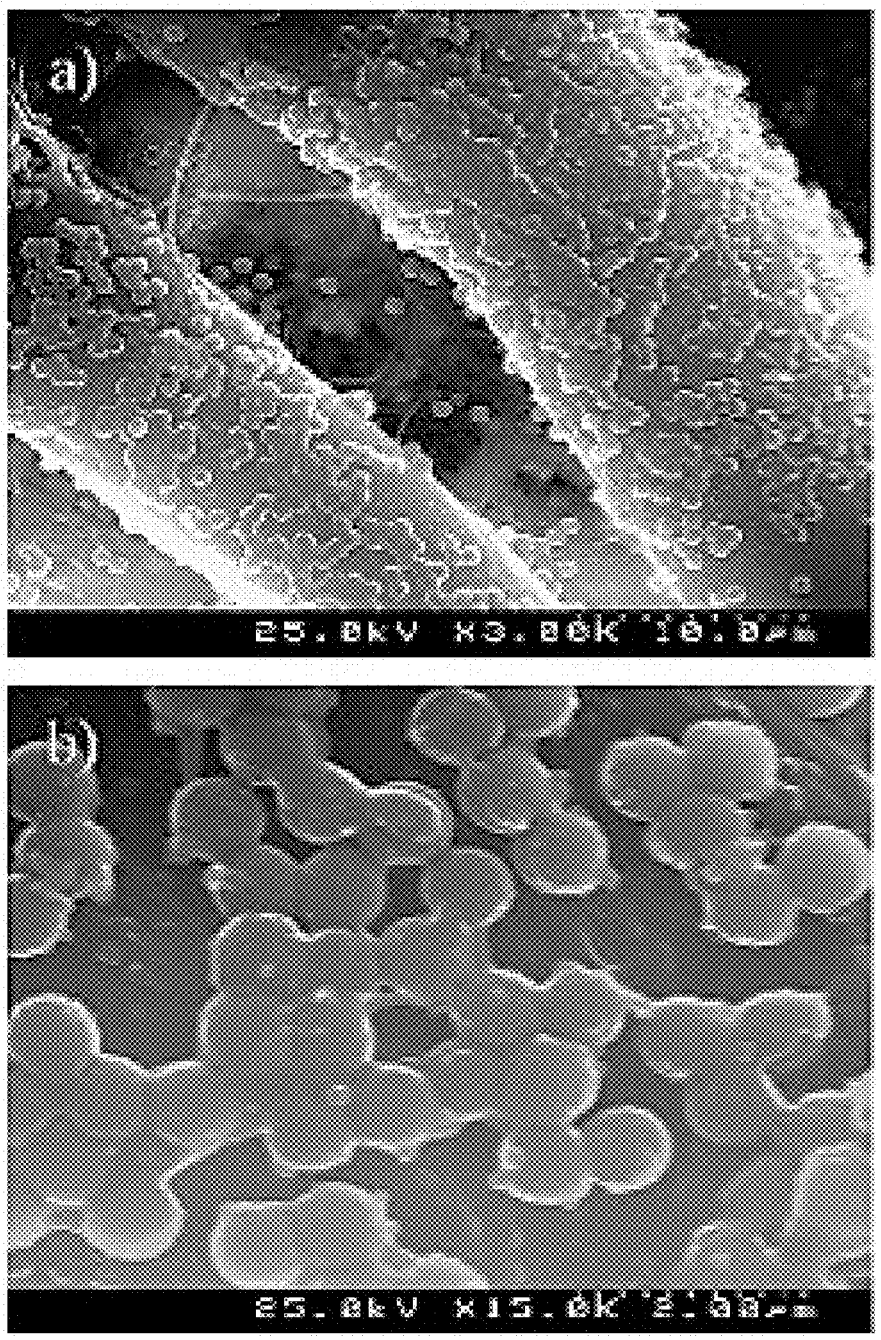
FIG. 12 shows a microphotograph obtained by scanning electron microscopy of the cellulose fibers of the paper or cardboard coated with self-assembled silicon-oxide nanoparticles according to the present invention.

Table 4 also shows the results obtained according to the Cobb values, the water contact angle and the water flow rate. In this table the Cobb values are observed as very low in all tests (from 16.7 $g_{water}/m^2$ to 26.8 $g_{water}/m^2$) for water flow rates of 0.036 g/s to 0.005 g/s, which shows a significant reduction of the water flow in both paper and cardboard due to the coating. From additional experimental tests, it was proved that with the process of the present invention Cobb values can be controlled within a range of 8 $g_{water}/m^2$ to 25 $g_{water}/m^2$. Also, high water contact angles can be observed for all cases (from 118.1° to128.9°), which confirms the great hydrophobicity of the coatings applied to both paper and cardboard. In highly hydrophobic surfaces the water contact angle is greater than 100°, in these cases water rests on the surface, but it does not wet nor spread over the surfaces, giving rise to the so-called lotus effect. In the present invention, the lotus effect is promoted by the self-assembled silicon-oxide nanoparticles that cover the cellulose fibers, resulting in a nano-rough topography on the surface thereof as shown in FIG. 12.

To evaluate the degree of hydrophobicity, the water contact angle was used and to measure the humidity absorption capacity of paper and cardboard the standards IMPEE-PL020 and TAPPI are used, which allow quantifying Cobb values and the rate of water penetration.

When conducting industry-wide testing it was found that the nanostructured hydrophobic coating prepared and applied in accordance with the present invention does not affect the printing of paper or cardboard, and improves adhesion on the wings or areas requiring bonding of cardboard boxes that were obtained. The former, because the silicon-oxide nanoparticles are directly linked to the cellulose fibers as shown in FIG. 5, unlike other commercial products where a monolithic layer is produced which covers the surface of paper or cardboard, modifying the printing and the gluing of cardboard when making boxes. In addition to tests at the industrial level, it was confirmed that the well dispersed nanostructured coatings of silicon-oxide nanoparticles reduce the amount of hydrophobic material required per surface unit of paper or cardboard, thus facilitating the process of recycling of such packaging.

Although the invention has been described with respect to a preferred embodiment, those skilled in the art will understand that various changes may be realized and equivalents may substitute its components without departing from the scope of the invention. Moreover, many modifications may be made to adapt a particular situation or material to the contents of the invention, without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A hydrophobic paper or cardboard comprising:

cellulose fibers; and self-assembled silicon-oxide nanoparticles functionalized with amine free functional silane groups and fluorocarbonated compounds;

wherein the amine free functional silane groups are selected from the group consisting of 3-Mercaptopropyltrimethoxysilane (MPTMS), 3-Glycidoxypropyltrimethoxysilane (GLYMO), Bis[3-(triethoxysilyl)propyl] tetrasulfide (TETRA-S), 1,2-Bis(triethoxysilyl) ethane (BTSE), dichlorodiphenylsilane, 3-isocyanatopropyltrimethoxysilane, 1,2-Bis (chlorodimethylsilyl)ethane, N-[3-(trimethoxysilyl)propyl] aniline, 3-(Mercapto methyl)octyl)silane-triol, 2-(2-Mercaptoethyl)pentyl)silane-triol, and combinations thereof;

wherein the fluorocarbonated compounds are selected from a group consisting of 2,3,5,6-tetrafluoro-4-methoxystyrene, monomers of acrylamide fluoridated, or 1H,1H,2H,2H-Perfluorooctyltrietoxysilane, and combinations thereof; and wherein the self-assembled silicon-oxide nanoparticles are linked directly by covalent bonds at pH from 3 to 4.5 to cellulose fibers through the amine free functional silane groups.

2. The hydrophobic paper or cardboard of the claim 1, wherein it has a Cobb value from 8 to 25 g/m$^2$.

3. The hydrophobic paper or cardboard of claim 1, wherein it has a water contact angle from 100° to 140°.

4. The hydrophobic paper or cardboard of claim 1, wherein at least a surface of the paper or cardboard has an amount of self-assembled silicon-oxide nanoparticles less than 3.5 g/m$^2$ per square meter of paper or cardboard.

5. A method for producing a hydrophobic paper or cardboard comprising the steps of:

preparing a dispersion of self-assembled silicon-oxide nanoparticles functionalized with amine free functional silane groups and fluorocarbonated compounds in a hydro-alcoholized medium at pH from 3 to 4.5; wherein the amine free functional silane groups are selected from the group consisting of 3-Mercaptopropyltrimethoxysilane (MPTMS), 3-Glycidoxypropyltrimethoxysilane (GLYMO), Bis[3-(triethoxysilyl)propyl] tetrasulfide (TETRA-S), 1,2-Bis(triethoxysilyl) ethane (BTSE), dichlorodiphenylsilane, 3-isocyanatopropyltrimethoxysilane, 1,2-Bis (chlorodimethylsilyl)ethane, N-[3-(trimethoxysilyl)propyl] aniline, 3-(Mercapto methyl)octyl)silane-triol, 2-(2-Mercaptoethyl)pentyl)silane-triol, and combinations thereof; and wherein the fluorocarbonated compounds are selected from a group consisting of 2,3,5,6-tetrafluoro-4-methoxystyrene, monomers of acrylamide fluoridated, or 1H,1H,2H,2H-Perfluorooctyltrietoxysilane, and combinations thereof;

applying the dispersion on at least one surface of a paper or cardboard; and drying and curing the paper or cardboard to directly link the self-assembled silicon-oxide nanoparticles with the cellulose fibers of the paper or cardboard by covalent bonds through the amine free functional silane groups.

6. The method of the claim 5, wherein the dispersion has a density from 0.96 to 0.99 g/cm$^3$.

7. The method of making paper or cardboard of the claim 5, wherein the step of preparing a dispersion of self-assembled silicon-oxide nanoparticles, the hydro-alcoholized medium includes an alcohol selected from a group consisting of ethanol, propanol, methanol, and combinations thereof.

8. The method of the claim 5, wherein the step of preparing a dispersion of self-assembled silicon-oxide nanoparticles, the self-assembled silicon-oxide nanoparticles are dispersed by mechanical stirring with ultrasonic support.

9. The method of the claim 8, wherein the ultrasound is performed at a continuous or pulsed frequency.

10. The method of the claim 8, wherein the ultrasound is performed at a frequency from 10 to 150 KHz.

11. The method of the claim 5, wherein the step of applying the dispersion on at least one surface of a paper or cardboard consists in immersion-extraction of the paper or cardboard in the dispersion.

12. The method of the claim 11 wherein further the step of applying the dispersion on at least one surface of a paper or cardboard, includes the step of evenly dosing and distributing the dispersion on the surface of the paper or cardboard by means of a scraper.

13. The method of the claim 5, wherein the step of applying the dispersion on at least one surface of a paper or cardboard, the dispersion is applied in an amount less than 3.5 g/m$^2$ per square meter of the paper or cardboard.

14. The method of the to claim 5, wherein the step of drying and curing the paper or cardboard is performed at a temperature from 80 to 170° C.

15. The method of the claim 5, wherein the paper or cardboard has a Cobb value from 8 to 25 g/m$^2$.

16. The method of the claim 5, wherein the step of preparing a dispersion of self-assembled silicon-oxide nanoparticles is performed at a temperature from 10 to 250° C.

* * * * *